US006520082B1

(12) United States Patent
Goldburt et al.

(10) Patent No.: US 6,520,082 B1
(45) Date of Patent: Feb. 18, 2003

(54) REMOVABLE INK CASSETTE FOR A PRINTING PRESS

(75) Inventors: Mikhail Goldburt, St. Louis, MO (US); Dave Telken, St. Peters, MO (US)

(73) Assignee: Delaware Capital Formation, Inc., Wilmington, DE (US)

( * ) Notice: Subject to any disclaimer, the term of this patent is extended or adjusted under 35 U.S.C. 154(b) by 20 days.

(21) Appl. No.: 09/610,981

(22) Filed: Jul. 6, 2000

(51) Int. Cl.[7] ..... B41F 31/00

(52) U.S. Cl. ..... 101/350.1; 364/367

(58) Field of Search ..... 101/364–367, 101/351.1, 483, 487, 148, 326, 330, 331, 350, 350.1, 350.2, 350.3, 350.4, 350.5, 350.6, 352.01, 352.02, 352.03, 352.04, 352.05, 356, 357, 320, 341, 247, 479, 219

(56) References Cited

U.S. PATENT DOCUMENTS

| | | | | | |
|---|---|---|---|---|---|
| 1,843,048 | A | * | 1/1932 | Spence | 101/351.1 |
| 3,818,830 | A | * | 6/1974 | Schultz | 101/364 |
| 4,051,781 | A | * | 10/1977 | Nishikawa | 101/348 |
| 4,138,944 | A | | 2/1979 | Biggar, III | |
| 4,401,031 | A | * | 8/1983 | Buan | 101/363 |
| 4,580,496 | A | * | 4/1986 | Buan et al. | 101/348 |
| 4,637,310 | A | * | 1/1987 | Sato et al. | 101/350 |
| 4,697,517 | A | * | 10/1987 | Fassman et al. | 101/348 |
| 4,878,427 | A | * | 11/1989 | Washchynsky | 101/219 |
| 4,901,641 | A | * | 2/1990 | Steiner et al. | 101/350.1 |
| 5,088,407 | A | * | 2/1992 | Helm et al. | 101/367 |
| 5,167,188 | A | * | 12/1992 | Lindalom | 101/364 |
| 5,224,422 | A | * | 7/1993 | Marozzi et al. | 101/228 |
| 5,584,243 | A | | 12/1996 | Kern | |
| 5,832,828 | A | * | 11/1998 | Marmin et al. | 101/365 |
| 5,894,798 | A | * | 4/1999 | Miyoshi et al. | 101/363 |
| 5,979,321 | A | * | 11/1999 | Koppelkamm et al. | 101/363 |
| 6,082,257 | A | * | 7/2000 | Secor | 101/350.3 |
| 6,283,024 | B1 | * | 9/2001 | George | 101/247 |
| 6,339,989 | B1 | * | 1/2002 | Fujimoto et al. | 101/367 |
| 6,354,213 | B1 | * | 2/2002 | Jenkins | 101/483 |

FOREIGN PATENT DOCUMENTS

| | | | | |
|---|---|---|---|---|
| CH | 0609280 | * | 2/1979 | 101/364 |
| DE | 3308991 | * | 12/1983 | 101/364 |
| DE | 42 38 672 | | 5/1993 | |
| EP | 0387811 | * | 9/1990 | 101/364 |
| EP | 0 456 383 | | 11/1991 | |
| GB | 604569 | * | 7/1948 | 101/364 |
| GB | 605 797 | * | 7/1948 | 101/364 |
| GB | 2 332 393 | | 6/1999 | |

* cited by examiner

*Primary Examiner*—Eugene H. Eickholt
(74) *Attorney, Agent, or Firm*—Foley & Lardner

(57) ABSTRACT

There is provided a removable ink cassette for a flexographic printing press containing an ink pan and a meter roll. The ink pan and the meter roll are removed from the printing press together by removing the ink cassette from the printing press. The ink pan may be removed from the printing press without first removing the anilox roll and the meter roll.

22 Claims, 5 Drawing Sheets

REMOVABLE INK CASSETTE FOR A PRINTING PRESS

BACKGROUND OF THE INVENTION

This invention relates generally to printing press components, and specifically to a removable ink cassette containing an ink pan and a meter roll.

Flexographic printing presses are used to print various images on a moving web. Such printing presses contain at least four rolls and an ink pan or tray. In a typical roll configuration, the meter or fountain roll is located above the ink pan and collects the ink(s) from the ink pan. The meter roll transfers the ink(s) to the anilox roll. The anilox roll in turn transfers the ink(s) to a textured plate roll, which contains the image to be printed onto the moving web. The plate roll contacts the first side of the moving web to transfer the image to the first side of the web. An impression cylinder contacts the second side of the moving web to press the web against the plate cylinder.

However, the present inventors have realized that the prior art flexographic printing presses suffer from the following disadvantages. The ink pan, the meter roll and anilox roll in these printing presses are contained as separate elements in a housing, which is permanently attached to the printing press frame. These permanent housings sometimes require special tools to remove the ink pan and the meter roll from the printing press. Furthermore, in order to remove the ink pan from the printing press for cleaning and ink changing, the press operator first has to separately remove the anilox roll from the printing press and then remove the meter roll from the ink pan before removing the ink pan from the printing press. The separate roll removal steps lead to an increased down time for the printing press while the ink pan is being removed for cleaning. The present invention is directed to overcoming or at least reducing the problems set forth above.

SUMMARY OF THE INVENTION

In accordance with one aspect of the present invention, there is provided a removable ink cassette for a printing press, comprising an ink pan and a meter roll, wherein the ink pan and the meter roll are removed from the printing press together by removing the ink cassette from the printing press.

In accordance with another aspect of the present invention, there is provided a flexographic printing press, comprising a printing press frame, a first means for mounting an ink pan and a meter roll at the same time to the printing press frame and for removing the ink pan and the meter roll at the same time from the printing press frame, an anilox roll, a plate roll, and an impression roll.

In accordance with another aspect of the present invention, there is provided a method of assembling a flexographic printing press, comprising providing a removable ink cassette containing an ink pan and a meter roll, guiding the ink cassette into a predetermined location on the printing press, and removably securing the ink cassette to a printing press frame.

In accordance with another aspect of the present invention, there is provided a method of disassembling a flexographic printing press, comprising releasing an ink cassette containing an ink pan and a meter roll from the printing press frame without removing an anilox roll from the printing press frame, and transferring the ink cassette to a first location remote from the printing press.

DETAILED DESCRIPTION OF THE INVENTION

In view of the problems in the prior art, it is desirable to obtain an ink pan which is removable from the printing press without first removing the anilox roll and/or the meter roll from the printing press. It is also desirable to obtain an ink pan which may be removed from the printing press together with the meter roll for cleaning.

The present inventors h have discovered that the ink pan may be removed from the printing press without first removing the anilox roll and/or the meter roll by incorporating the ink pan and the meter roll into a removable ink cassette. By removing the ink cassette from the printing press, the press operator simultaneously removes the ink pan and the meter roll from the printing press. The simultaneous removal of the ink pan and the meter roll reduces the printing press down time by eliminating separate roll and ink pan removal steps.

Figure 1:
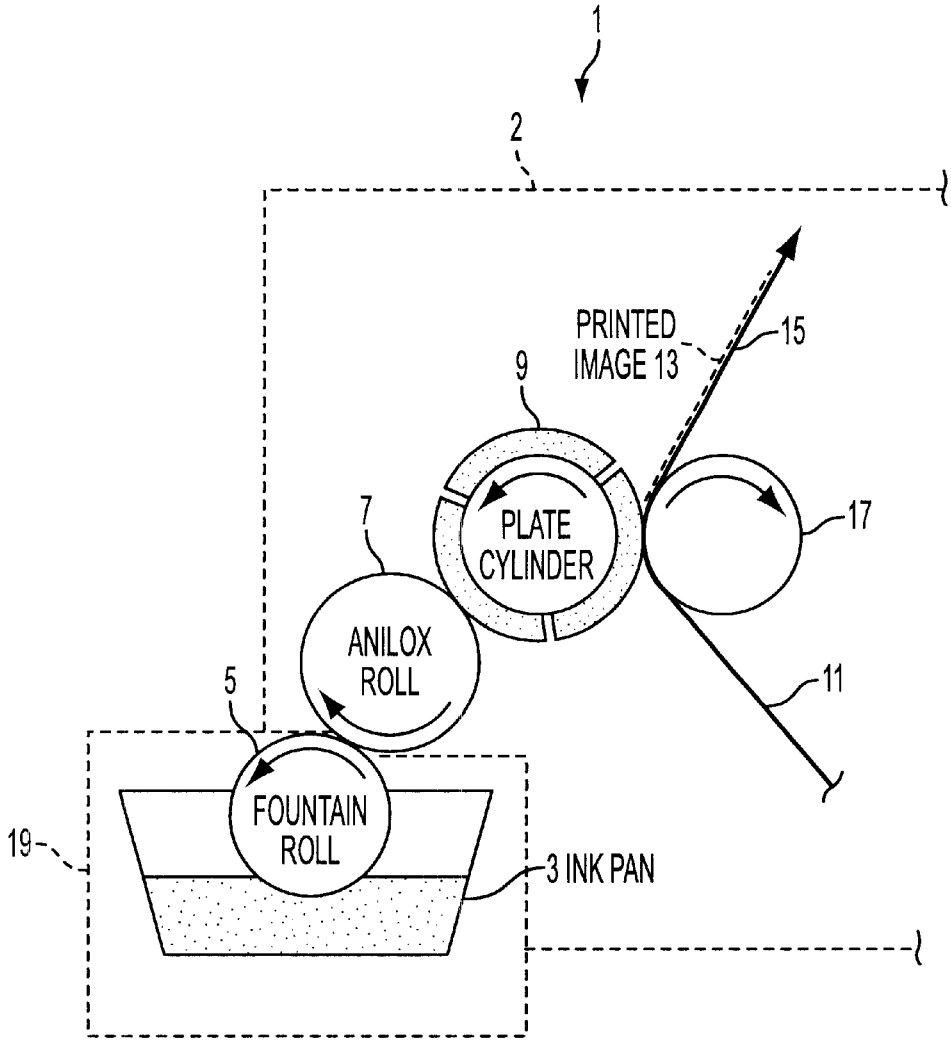
FIG. 1 is schematic illustration of the components of a flexographic printing press.

FIG. 1 is a schematic illustration of a flexographic printing press 1 according to one aspect of the present invention. The printing press 1 according to one aspect of the present invention contains a printing press frame 2 (schematically illustrated by dashed lines), at least four rolls (also known as cylinders), and an ink pan or tray 3. The meter roll 5 (also known as a fountain roll) is located above the ink pan 3 and collects the ink(s) from the ink pan. The meter roll transfers the ink(s) to the anilox roll 7. The anilox roll 7 in turn transfers the ink(s) to a textured plate roll or cylinder 9, which contains the image to be printed onto the moving web 11. The plate roll 9 contacts the first side 13 of the moving web 11 to transfer the image to the first side of the web. An impression roll or cylinder 17 contacts the second side 15 of the moving web 11 to press the web against the plate roll 9. The ink pan 3 and the meter roll 5 comprise the ink cassette 19 (schematically illustrated by the dashed lines in FIG. 1). Thus, by mounting and removing the ink cassette 19 to and from the printing press 1, the press operator mounts and removes the ink pan 3 and the meter roll 5 on and from the press 1 at the same time. Furthermore, by using the ink cassette 19, the ink pan 3 can be mounted on and removed from the printing press 3 without first removing the anilox roll 7 and without using special removal tools.

Figure 2:
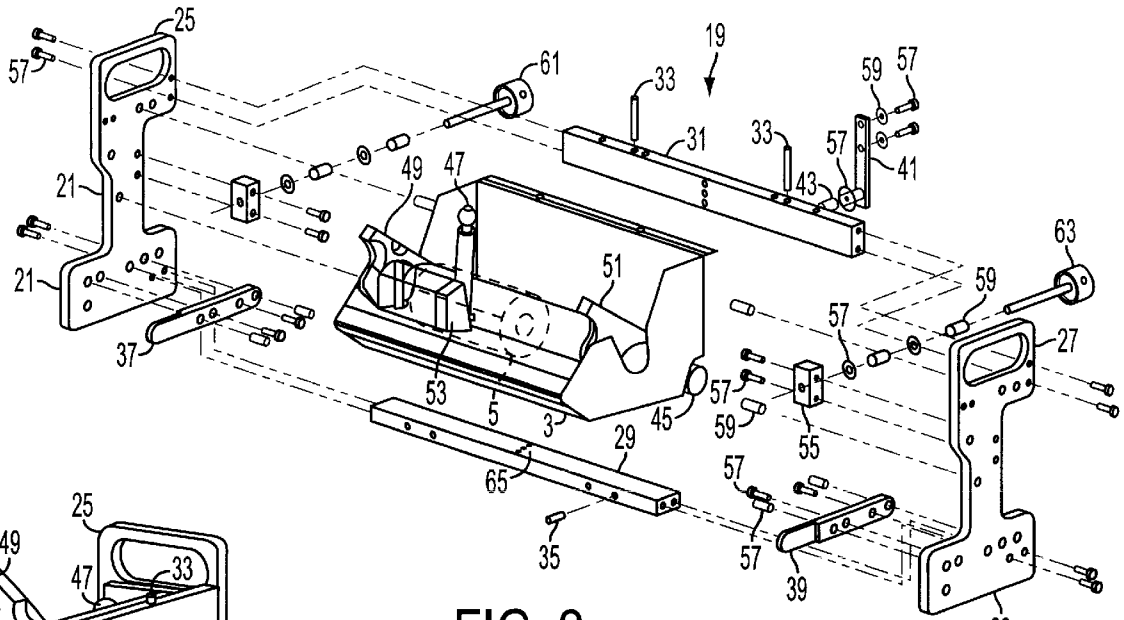
FIG. 2 is a front three dimensional cut away view of an ink cassette of a preferred embodiment of the present invention.

FIG. 2 illustrates the elements of a removable ink cassette 19 according to a preferred embodiment of the present invention. The ink cassette 19 contains an ink pan 3 and a meter roll 5 (illustrated in cut away three dimensional view by dashed lines). The meter roll 5 may be mounted over the ink pan 3 and removed from ink pan 3 while the ink cassette 19 is removed from the printing press 1. The ink cassette may also contain one or more of the following components illustrated in FIG. 2. However, some or all of the following components may be omitted and/or substituted with other equivalent elements.

The ink cassette 19 illustrated in FIG. 2 contains two side plates 21, 23 on either side of the ink pan 3. The side plates 21, 23 preferably contain handles 25, 27 to allow the press operator to mount and remove the ink cassette 19 to and from the printing press. The handles 25, 27 may comprise separate elements from the side plates 21, 23, or each side plate and the respective handle may comprise a unitary body. The side plates and the handles may be made of any suitable material and may have any suitable shape. Preferably, the side plates and the handles are made from aluminum.

The ink cassette 19 also contains at least one, and preferably two spacer bars. The spacer bars connect the side plates and the ink pan to each other. For example, as shown in FIG. 2, the lower spacer bar 29 connects the side plates 21, 23. The back spacer bar 31 connects the side plates 21, 23 and supports the ink pan 3 from behind. The spacer bar(s) 29, 31 may have any suitable shape and may be made of any suitable material, such as aluminum.

The ink pan 3 is connected to the back spacer bar 31 by holding pins or screws 33. However, any other attachment elements may be used to attach the ink pan to the back spacer bar. Furthermore, if desired, the ink pan 3 may be supported by both spacer bars 29, 31 or by the lower spacer bar 29. Alternatively, the ink pan 3 may be supported by the side plates 21, 23. In this case, one or both spacer bars may be omitted, if desired.

Preferably, the ink cassette 19 contains at least one locating pin. For example, the locating pin 35 may be mounted on the lower spacer bar 29. The locating pin 35 fits into a locating opening in the frame of the printing press to assure precise orientation of the ink cassette 19 with the centerline of the printing press 1.

If desired, the ink cassette 19 may also contain at least one side guide bar. As shown in FIG. 2, two side guide bars 37, 39 are attached to the side plates 21, 23. However, the side guide bars 37, 39 may be instead attached to the lower spacer bar 29, if desired. The side guide bars 37, 39 may have any suitable shape and may be made of any suitable material, such as steel. Alternatively, the side guide bars may be omitted to simplify the ink cassette design. The side guide bars 37, 39 may be used in conjunction with the side plates 21, 23 as preliminary ink cassette 19 locators during the mounting of the ink cassette on the printing press, to prevent the ink cassette components from striking and damaging the anilox roll 7 of the printing press.

The ink cassette may optionally contain a supporting bracket 41 and a supporting knob 43. The supporting bracket 41 is attached to the back spacer bar 31, and the supporting knob 43 protrudes from the supporting bracket 41 toward the back of the ink pan 3. The supporting knob 43 exerts pressure on the back of the ink pan 3. Thus, the supporting bracket 41 and knob 43 prevent excessive vibration of the ink pan 3 during operation of the printing press by preventing the bottom of the ink pan 3 from swinging backwards during operation.

The ink pan 3 also contain an ink drain 45 and an ink drain stopper 47. By pulling up on the stopper, the press operator can drain the ink from the ink pan 3 out through the ink drain 45 without removing the ink cassette 19 from the printing press.

The ink cassette 19 also preferably contains various ink wipers or guards to prevent the ink from spilling sideways from the ink pan 3 during press operation. For example, two ink wipers 49, 51 are located on either side of the ink pan 3. The ink wipers 49, 51 contain semicircular openings that fit over the meter roll shaft and over the anilox roll shaft. Furthermore, sponge wipers 53 may be located between the ink wipers and the ink space in the ink pan to further decrease the sideways spilling of the ink during press operation.

Blocks 55 with threaded holes may also be added for meter roll adjustments, if desired. All of the above elements may be held together by various fasteners 57, such as screws bolts, pins or screws and washers. Furthermore, additional pins 59 may be added for limiting the downward movement of meter roll 5. The ink cassette 19 may also contain meter roll adjustment screws 61, 63 which may be turned to adjust the position of the meter roll 5. Springs 64 may be added to take out backlash in meter roll adjustment screws 61, 63, if desired. Furthermore, the lower spacer bar 29 contains a latch mounting location 65. The latch will be described in more detail below.

Figure 3:
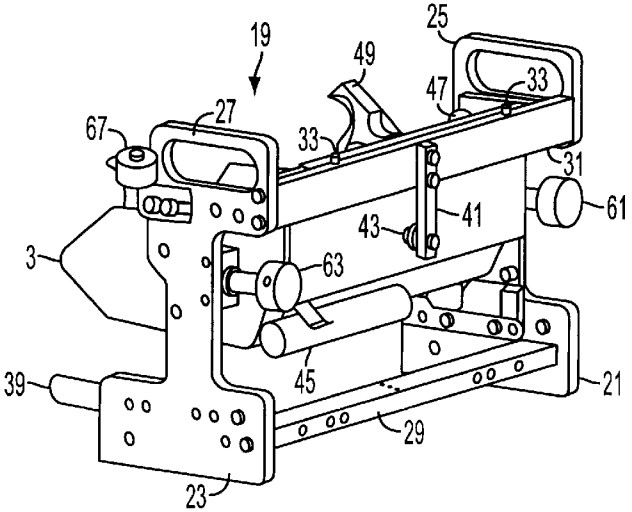
FIG. 3 is a rear three dimensional view of the ink cassette of the preferred embodiment of the present invention.

The back three dimensional view of the ink cassette 19 is illustrated in FIG. 3. This figure shows how the above described elements of the ink cassette 19 fit together. Furthermore, the ink cassette 19 may contain a safety switch 67, which must be actuated by the press operator to enable the operation of the printing press.

As described above, the side plates 21, 23, the handles 25, 27, the spacer bars 29, 31, and the side guide bars 37, 39 comprise a cassette frame which supports the ink pan 3. However, the cassette frame and the ink pan may comprise a single, unitary structure or body. For example, the ink cassette and the ink pan may comprise a single injection molded structure made of a suitable material, such as plastic. This structure may contain any or all of the above described side plate, handles, the spacer bar, and side guide bar elements integrally formed as part of the structure.

Figure 5:
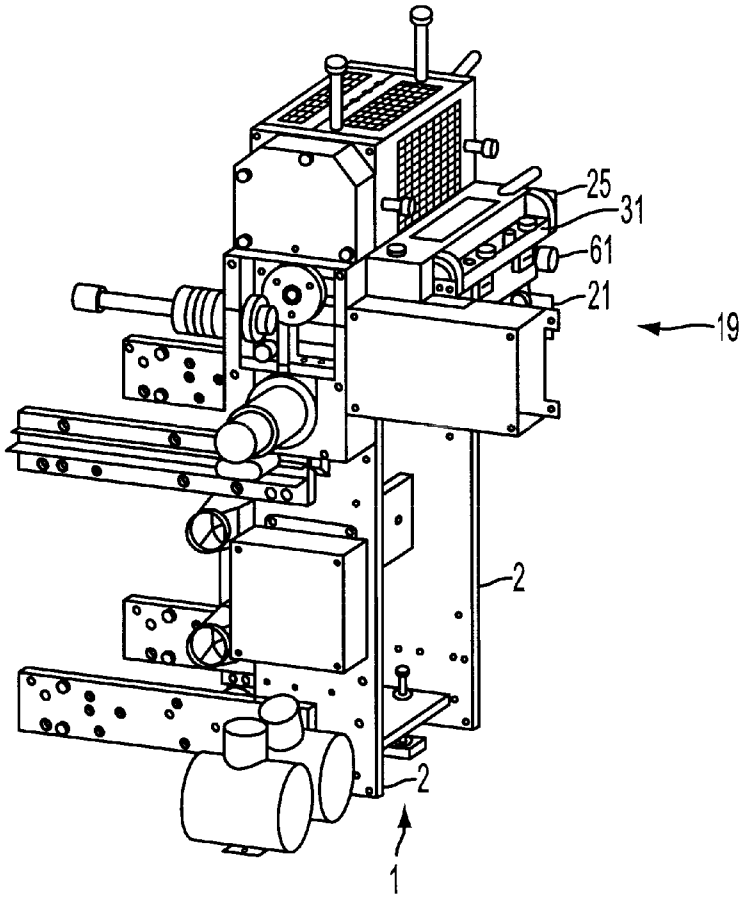
FIG. 5 is a rear three dimensional view of a flexographic printing press of the preferred embodiment of the present invention.
Figure 4:
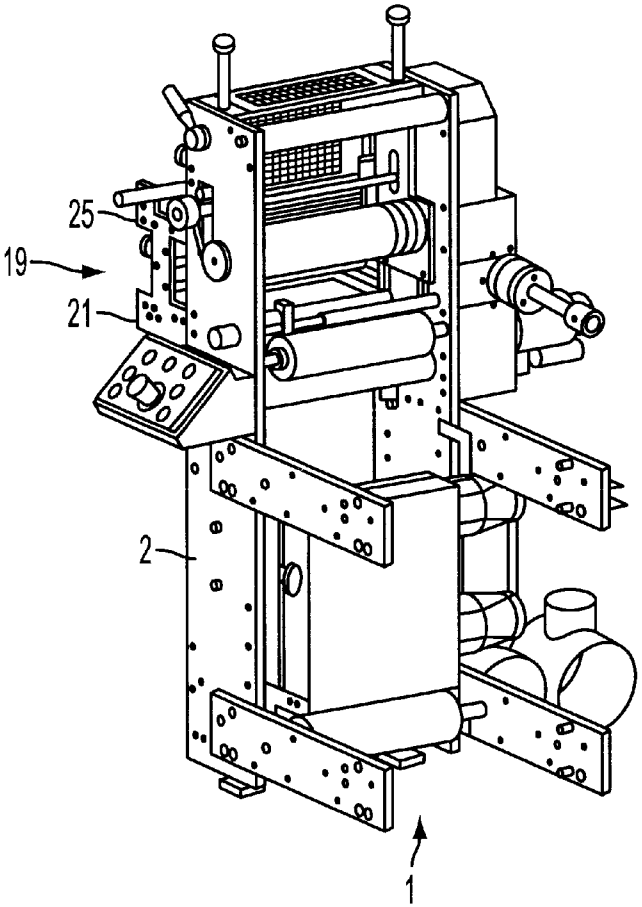
FIG. 4 is a front three dimensional view of a flexographic printing press of the preferred embodiment of the present invention.

FIG. 4 illustrates a front view of a flexographic printing press 1 according to the preferred embodiment of the present invention, where the ink cassette 19 is mounted to the printing press frame 2. FIG. 5 illustrates a back view of the flexographic printing press 1 according to the preferred embodiment of the present invention, where the ink cassette 19 is mounted to the printing press frame 2. The ink pan 3 and the meter roll 5 are mounted to the cassette 19 but not to the frame 2. As illustrated in FIGS. 4 and 5, the ink cassette 19 is easily accessible to the printing press operator. The operator can remove the ink cassette 19 from the printing press frame 2 by unlatching the cassette 19 and then lifting the cassette 19 out of the frame 2 by the handles 25, 27. Since the ink cassette 19 may be used with any type of printing press, other components of the printing press 1, such as a control pad, various web feed rollers, etc. will not be described further. Additionally, the removable ink cassette 19 may be used in other types of printing presses other than flexographic printing presses, such as gravure printing presses.

Figure 6:
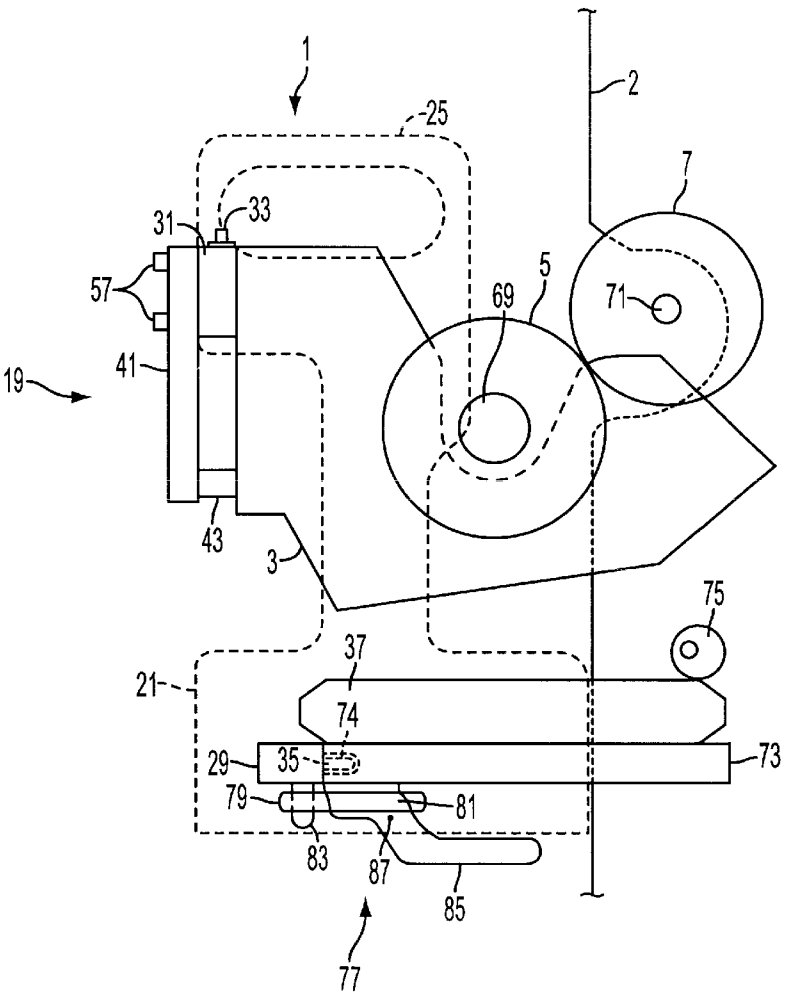
FIG. 6 is a side cross sectional view of a section of the flexographic printing press of the preferred embodiment of the present invention where the ink cassette is mounted on the printing press frame.

FIG. 6 illustrates a side cross sectional view of a section of a flexographic printing press 1 where the ink cassette 19 is mounted on the printing press frame 2. In FIG. 6, the left side plate 21, the left handle 25 and the locating pin 35 are illustrated as dashed lines because they are located behind the elements of the cross section, which are illustrated by solid lines. Some elements have been omitted for clarity.

The ink pan 3 is mounted to the back spacer bar 31 by a bracket and pins 33. The supporting bracket 41 and knob 43 prevent the ink pan 3 from swinging backwards, as described above. The lower spacer bar 29 is attached to the side plate 21, and the locating pin 35 is attached to the lower spacer bar 29.

The meter roll 5 is mounted on a meter roll shaft 69 to the ink cassette 19. The meter roll 5 is in contact with the anilox roll 7 mounted to the frame 2 by an anilox roll shaft 71. The ink wipers 49, 51 illustrated in FIG. 2 fit around the shafts 69, 71. The meter roll shaft 69 may be mounted to the ink cassette 19 by being threaded through the ink wipers 49, 51. Alternatively, the meter roll shaft 69 may be mounted to the cassette 19 by brackets. The anilox roll shaft 71 is mounted to the press frame 2 by bearing cartridges and latches (not shown).

In a preferred aspect of the present invention, the meter roll shaft 69 and the anilox roll shaft 71 are attached to mating gears (not shown) located on the side of the cassette 19. The gear attached to the anilox roll shaft 71 turns the gear attached to the meter roll shaft 69, thus turning the meter roll 5 in the ink pan 3, to provide the ink from the ink pan 3 to the anilox roll 7.

The printing press frame 2 contains a cassette support plate 73 mounted between the outer portions of the frame 2, as illustrated in FIG. 6. The support plate 73 may have any desired shape, such as a plate or slab shape, and may be made of any desired material, such as steel. Alternatively, the support plate may have a bar or a cylinder shape. The ink cassette 19 is mounted over the support plate 73 with the side guide bars 37, 39 resting on the support plate 73. The support plate 73 also contains a locating opening 74 into which the locating pin 35 is inserted to orient the ink cassette 19 with the printing press center line. Optionally, eccentric cams 75 may be located above the support plate 73, such that the cams press down on the side guide bars 37, 39 to compensate for a clearance between the side guide bars and the support plate 73. However, the ink cassette 19 may be mounted to the printing press frame 2 by any other attachment elements, such as by hooks, bolts or friction.

Preferably, the ink cassette 19 is also fastened to the printing press frame 2 in addition to being mounted on the support plate 73. The preferred fastening mechanism is an over-the-center latch 77 illustrated in FIG. 6. The latch 77 contains a "U" shaped horizontal latch bar 79 which pivots about a pivot axis 81. The latch bar 79 is connected to a lever 85 at axis 81. The lever 85 is rotatably or pivotably attached to the support plate 73 of the press frame 2 around a pivot axis 87. The latch bar 79 is attached to the ink cassette 19 via a latch catch 83. The latch catch 83 is connected to the lower spacer bar 29 of cassette 19 at location 65 in FIG. 2.

As illustrated in FIG. 6, the latch 77 is in the closed or latched position when the latch bar 79 is placed around the catch 83. When the latch 77 is in the closed position, the ink cassette 19 is prevented from slipping out from the frame 2 because the latch bar 79 holds the latch catch 83 and the lever 85 together.

Figure 7:
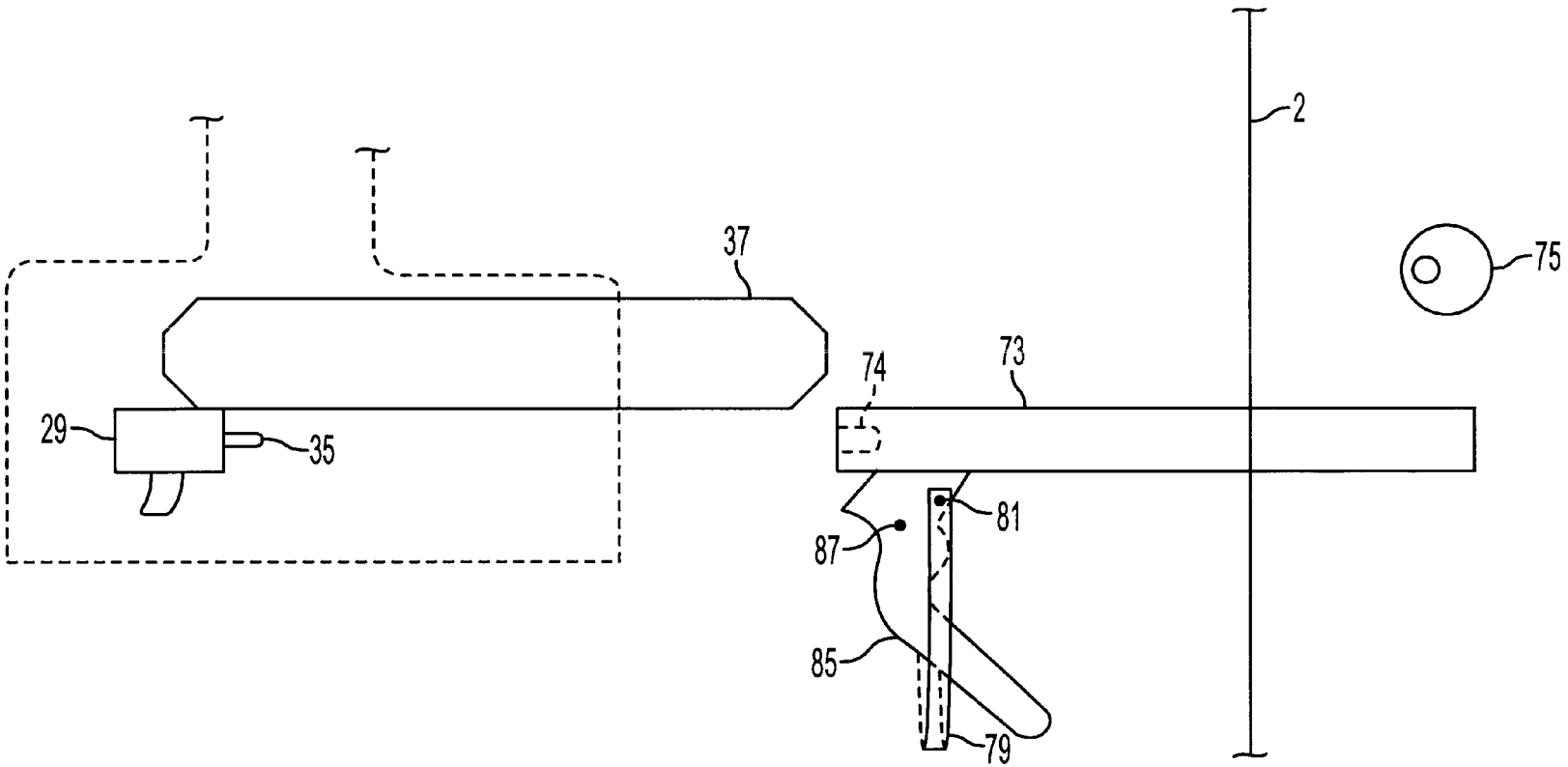
FIG. 7 is a side cross sectional view of a section of the flexographic printing press of the preferred embodiment of the present invention where the ink cassette is removed from the printing press frame.

As illustrated in FIG. 7, to open the latch, the press operator pivots the lever 85 down (clockwise) around axis 87. This allows the latch bar 79 to pivot down (counterclockwise) around axis 81 and slip off the catch 83, thus releasing the lever 85 from the latch catch 83. The ink cassette containing the side plate 21, the lower spacer bar 29, the locating pin 35 and the side guide bar 37 is then removed from the press frame 2 containing the support plate 73 and the eccentric cam 75, as shown in FIG. 7. The latch bar 79 and the lever 85 are in the open position in FIG. 7 (the back side of the latch bar 79 is shown by dashed lines to illustrate how the latch bar slips on around the catch 83).

However, various alternative latches and fastening mechanisms may be used instead of the latch 77. For example, the lever 85 may be attached to the cassette 19 while the latch catch 83 may be attached to the support plate 73 instead. Furthermore, the side plates 21, 23 of the cassette 19 may be fastened to the frame 2 in addition to or instead of fastening the lower spacer bar 29 to the support plate 73. The cassette 19 may also be fastened to the frame 2 and/or the support plate 73 by a threaded screw instead of or in addition to the latch 77.

A method of assembling and disassembling the flexographic printing press 1 according to the preferred embodiment of the present invention will now be described. The printing press 1 is assembled as follows. The press operator provides the removable ink cassette 19 containing the ink pan 3 and the meter roll 5 by bringing the cassette 19 toward the press frame 2. The operator may hold the cassette 19 by the handles 25, 27, if desired. The operator then guides the ink cassette 19 into a predetermined location on the printing press and removably secures the ink cassette 19 to the printing press frame.

The operator may guide the ink cassette 19 into the predetermined location by using the side plates 21, 23 and the side guide bars 37, 39 as preliminary locators. For example, the side guide bars may slide over the support plate 73 in the frame 2. Furthermore, if desired, grooves may be provided in the support plate 73 to allow the side guide bars 37, 39 to slide in the grooves. After the cassette 19 is preliminarily located over the support plate 73, the cassette 19 may be oriented with the printing press centerline by pushing the cassette 19 forward to insert the guiding pin 35 attached to the lower spacer bar 29 of the cassette into the guiding opening 74 on the support plate 73. The operator can then removably secure the cassette 19 to the frame 2 by latching the cassette 19 to the frame 2 by using the latch 77. The anilox roll 7 does not have to be removed and may remain attached to the frame 2 during the step of mounting the cassette 19 to the frame 2 and removing the cassette 19 from the frame 2.

The press operator disassembles the flexographic printing press 1 by releasing the ink cassette 19 containing the ink pan 3 and the meter roll 5 from the printing press frame 2 without removing an anilox roll 7 from the printing press frame 1, and transferring the ink cassette to a first location remote from the printing press 1. The operator releases the cassette 19 by pulling down on the lever 85 to lower the latch bar 79 and to unlatch the ink cassette 19 from the printing press frame 2.

After removing the cassette 19 from the printing press, the operator can transfer the cassette 19 to a cleaning station, where the meter roll 5 is removed from the cassette 19 and the ink pan 3 and the meter roll 5 are cleaned. While the cassette is removed, the anilox roll 7 may be cleaned while it is still mounted on the press 1. The cassette 19 is then remounted to the press 1 after the step of cleaning the ink pan 3. Alternatively, in order to further decrease press down time, a second ink cassette containing a filled ink pan and a meter roll may be mounted on the press for the next press run while the first ink cassette is being cleaned. Thus, the ink cassette 19 of the preferred embodiment of the present invention decreases press set up time and eases the clean up of the ink pan 3 by allowing the mounting and removal of the ink pan 3 together with the meter roll 5 without removing the anilox roll 7.

The preferred embodiments have been set forth herein for the purpose of illustration. However, this description should not be deemed to be a limitation on the scope of the invention. Accordingly, various modifications, adaptations, and alternatives may occur to one skilled in the art without departing from the spirit and scope of the claimed inventive concept.

What is claimed is:

1. A removable ink cassette for a printing press having an anilox roll, comprising:

an ink pan; and a meter roll;

wherein the ink pan and the meter roll are removed from the printing press together by removing the ink cassette from the printing press; and wherein the cassette is adapted to be removable from the printing press without removing said anilox roll from the printing press.

2. The ink cassette of claim 1, further comprising a latch which is adapted to fasten the ink cassette to the printing press.

3. The ink cassette of claim 1, wherein the ink cassette and the ink pan comprise a single injection molded structure.

4. The ink cassette of claim 1, wherein the meter roll is attached to the cassette.

5. The ink cassette of claim 1, wherein the meter roll is located inside the ink pan.

6. The ink cassette of claim 5, wherein:

the meter roll is the only roll located inside the ink pan; and the meter roll is adapted to contact the anilox roll when the cassette is located in the printing press.

7. A removable ink cassette for a printing press, comprising:

an ink pan;

a meter roll;

two side plates located connected to sides of the ink pan and at least one spacer bar connecting the side plates; and wherein the ink pan and the meter roll are removed from the printing press together by removing the ink cassette from the printing press.

8. The ink cassette of claim 7, further comprising at least one locating pin on the at least one spacer bar, wherein the pin is adapted to fit into a locating opening in a printing press frame.

9. The ink cassette of claim 8, further comprising at least one side guide bar.

10. The ink cassette of claim 9, further comprising handles on the side plates.

11. The ink cassette of claim 10, further comprising:

a second spacer bar;

a supporting bracket attached to the second spacer bar;

at least two ink wipers; and at least one meter roll adjustment screw.

12. An ink cassette located in a flexographic printing press comprising a printing press frame, an anilox roll, a plate roll, and an impression roll, wherein the ink cassette comprises:

an ink pan; and a meter roll;

wherein:

the ink pan and the meter roll are removed from the printing press together by removing the ink cassette from the printing press; and the cassette is removable from the printing press without removing the anilox roll from the printing press.

13. The ink cassette of claim 12, wherein the ink pan and the meter roll are mounted to the ink cassette but not to the printing press frame.

14. The ink cassette of claim 13, further comprising:

a cassette support plate supporting the ink cassette; and at least one eccentric cam above the support plate.

15. The ink cassette of claim 14, further comprising:

a latch fastening the support plate to the ink cassette; and a locating pin connected to the ink cassette and inserted into a connecting opening in the support plate.

16. The ink cassette of claim 14, further comprising:

two side plates located adjacent to sides of the ink pan;

at least one spacer bar connecting the side plates;

at least one locating pin on the at least one spacer bar;

at least one side guide bar;

handles on the side plates;

a second spacer bar;

a supporting bracket attached to the second spacer bar;

at least two ink wipers; and at least one meter roll adjustment screw.

17. A removable ink cassette for a printing press having an anilox roll, comprising:

an ink pan;

a meter roll located in the ink pan;

two side plates; and handles on the side plates;

wherein the ink pan and the meter roll are removed from the printing press together by removing the ink cassette from the printing press; and the cassette is adapted to be removable from the printing press without removing said anilox roll from the printing press.

18. The ink cassette of claim 17, further comprising a latch which is adapted to fasten the ink cassette to the printing press.

19. A removable ink cassette for a printing press, comprising:

an ink pan;

a meter roll located in the ink pan;

two side plates; and handles on the side plates;

at least one spacer bar connecting the side plates;

at least one locating pin on the at least one spacer bar; and at least one side guide bar;

wherein the ink pan and the meter roll are removed from the printing press together by removing the ink cassette from the printing press.

20. The ink cassette of claim 19, further comprising:

a second spacer bar;

a supporting bracket attached to the second spacer bar;

at least two ink wipers; and at least one meter roll adjustment screw.

21. The ink cassette of claim 20, wherein the ink cassette and the ink pan comprise a single injection molded structure.

22. A removable ink cassette for a printing press having an anilox roll, comprising:

an ink pan;

a meter roll located in the ink pan; and a handle;

wherein the ink pan and the meter roll are removed from the printing press together by removing the ink cassette from the printing press; and the cassette is adapted to be removable from the printing press without removing said anilox roll from the printing press.

* * * * *